United States Patent [19]

Maixner et al.

[11] 4,302,926

[45] Dec. 1, 1981

[54] MULTI-COMPONENT YARN AND METHOD OF APPARATUS FOR ITS MANUFACTURE

[75] Inventors: Vaclav Maixner, Dolni Dobrouc; Zdenek Miklas, Ceska Trebova; Frantisek Velinsky, Usti nad Orlici; Cestmir Rypka, Ceska Trebova; Premysl Vorisek, Chocen; Vaclav Rohlena; Vaclav Divis, both of Usti nad Orlici, all of Czechoslovakia

[73] Assignee: Vyzkumny ustav bavlnarsky, Usti nad Orlici, Czechoslovakia

[21] Appl. No.: 107,770

[22] Filed: Dec. 28, 1979

[30] Foreign Application Priority Data

| | | | |
|---|---|---|---|
| Dec. 28, 1978 | [CS] | Czechoslovakia | 9054-78 |
| Oct. 29, 1979 | [CS] | Czechoslovakia | 7348-79 |
| Oct. 29, 1979 | [CS] | Czechoslovakia | 7349-79 |

[51] Int. Cl.[3] ..... D01H 7/882

[52] U.S. Cl. ..... 57/58.95; 57/3; 57/58.89

[58] Field of Search ..... 57/3, 6, 58.89–58.95, 57/210, 225, 226, 243

[56] References Cited

U.S. PATENT DOCUMENTS

| | | | |
|---|---|---|---|
| 3,445,993 | 5/1969 | Vorisek | 57/58.95 X |
| 3,605,395 | 9/1971 | Morikawa | 57/58.95 X |
| 4,083,173 | 4/1978 | Artzt et al. | 57/58.95 |
| 4,219,996 | 9/1980 | Edagawa et al. | 57/225 |

*Primary Examiner*—Donald Watkins

[57] ABSTRACT

Multi-component yarn comprising as one component an open end yarn core formed in an open end spinning chamber from staple fibers, and at least a further component consisting of a longitudinal formation which is wrapped on this yarn core in said spinning chamber, advantageously along a helix in the direction of the twist of the yarn core while maintaining the original character of the formation wrapped on the yarn core. The invention also includes the method of and the apparatus for forming such multi-component yarn.

4 Claims, 8 Drawing Figures

MULTI-COMPONENT YARN AND METHOD OF APPARATUS FOR ITS MANUFACTURE

BACKGROUND OF THE INVENTION

The invention relates to a multicomponent yarn, comprising as one component an open end yarn core formed from staple fibers and a component forming a longitudinal formation from silk, yarn and the like and a method of and apparatus for the manufacture of such yarn.

The manufacture of a two-component yarn directly in a spinning rotor chamber is, for instance, disclosed in U.S. Pat. No. 3,445,993, in which on a yarn core, in the course of its passage through the spinning chamber, there is wrapped staple yarn, which has been formed in the spinning chamber in the section thereof between the entrance into the yarn withdrawal channel and the yarn withdrawing rollers. The speed of feeding the yarn core into the spinning rotor is determined by the withdrawing speed of the rollers which withdraw the yarn. The yarn core is stored on a freely rotatable countershaft bobbin, which is arranged so as to secure a constant pull and winding off of the yarn core; the latter passes over a brake situated below the countershaft bobbin. The formation of different kinds of two component, that is, of core yarns, is also disclosed in French Pat. No. 1,567,718, in which the yarn core is introduced into the spinning rotor onto the collecting surface on fibers deposited thereon or in the close neighborhood of this collecting surface, where both components, i.e. the yarn core and the fibers deposited on the collecting surface, are connected by twisting and thus form a single yarn, whereby the yarn core due to contact with the collecting surface is given a false twist. By this mutual twisting the yarn core is shortened, and in consequence thereof the withdrawing speed of the resulting yarn is always adjusted to be somewhat lower than the feeding speed of the yarn core.

A similar method and apparatus for forming a core yarn is described in Swiss Pat. No. 585,284. A drawback of these known methods and arrangements is that only a limited variety of core yarns can be obtained the properties of which can be altered by changing the withdrawing speed of the core yarn. This withdrawing speed, however, cannot be altered at will as it is always necessary to observe conditions for folding up the fibers from the collecting surface to form the final yarn.

It is known that a stronger and more uniform yarn is obtained by twisting two or more yarns together. The direction and number of twists influence the properties of twisted yarns. In the case of yarns twisted in direction z+z/Z, s+s/S with a normal number of twists, a hard and coarse yarn is obtained. When using twists z+s/S Z+s/Z one of them is twisted, and the other is untwisted. The manufacture of different yarns designed for a visual effect is known, and, in addition to core yarns, spiral yarns are also made, such spiral yarns usually comprising one or more fundamental yarns, one or more yarns for visual effect, and further crossing yarns. The thus composed yarn is manufactured by double twisting. By the preliminary twist a preliminary yarn is prepared—the fundamental yarn is twisted together with the effective yarn, whereby both yarns are disposed at a certain mutual angle with respect to their axis; in the second twisting the preliminary yarn is twisted together with one crossing yarn in a counter-direction. The twisting direction is chosen in the second twisting so that in the course of fixing or crossing, the fundamental yarn is additionally twisted and the effective yarn is untwisted. From this review, it is obvious that the manufacture of multi-component yarns requires a considerable amount of labor and is costly, and that the individual yarns in the course of twisting change their character.

SUMMARY OF THE INVENTION

It is an object of this invention to provide a new kind of multi-component yarn which is similar to twisted yarns, but is manufactured by a simpler method with a simultaneous forming of one component of the yarn by the known OE spinning method in a spinning rotor.

The main feature of the multi-component yarn according to this invention is that open end yarn obtained in a known spinning rotor is wrapped around its surface and in the direction of its twisting by at least one longitudinal formation while maintaining the original properties of this formation.

According to one advantageous embodiment according to this invention the open end yarn is wrapped by at least two longitudinal formations along a common helix with the same pitch. The method of forming the multi-component yarn according to this invention consists in that the open end yarn formed within the spinning rotor and guided from the collecting surface of the spinning rotor to its take-up channel, is wrapped in the course of passage through this channel by at least one longitudinal formation passing through the spinning rotor substantially in its rotation axis to the take-up channel at a higher speed than the speed at which the open end yarn is entering this channel.

According to another advantageous embodiment, the method of forming multi-component yarn consists in that the longitudinal formations enter the take-up channel at speeds which are mutually different, but higher, than the speed at which the open end yarn enters this channel. In the apparatus for carrying out this method, there is provided opposite to the take-up channel substantially in its axis of rotation with at least one feeding channel for the supply of the longitudinal formation, there being provided individual feeding rollers with adjustable feeding speeds and individual bobbins with longitudinal formations for each feeding channel.

An advantage of the multi-component yarn according to this invention is that each component maintains its original character. No twists are added or removed from any component. It is important that this multi-component yarn is produced simultaneously with the production of the open end yarn in the spinning rotor, so that costs for doubling and twisting which would otherwise be necessary are saved.

DESCRIPTION OF THE DRAWINGS

The characteristic properties of multi-component yarns according to this invention, and the method of and apparatus for their manufacture are illustrated in the attached drawings, wherein:

FIG. 8 is a sectional elevation of an apparatus with a plurality of feeding channels.

Figure 4:
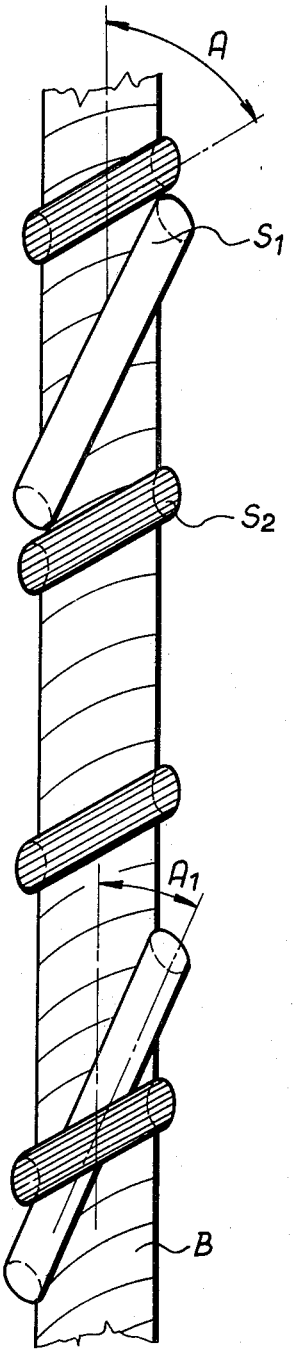
FIG. 4 is a similar view of a multi-component yarn with two longitudinal formations having different pitches of their helices.
Figure 5:
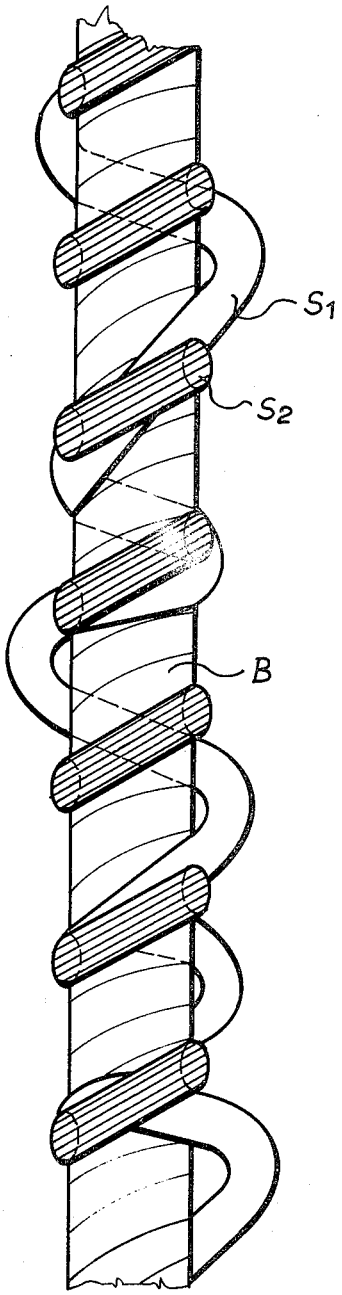
FIG. 5 is a similar view of another type of multi-component yarn, such yarn being a loop yarn.
Figure 6:
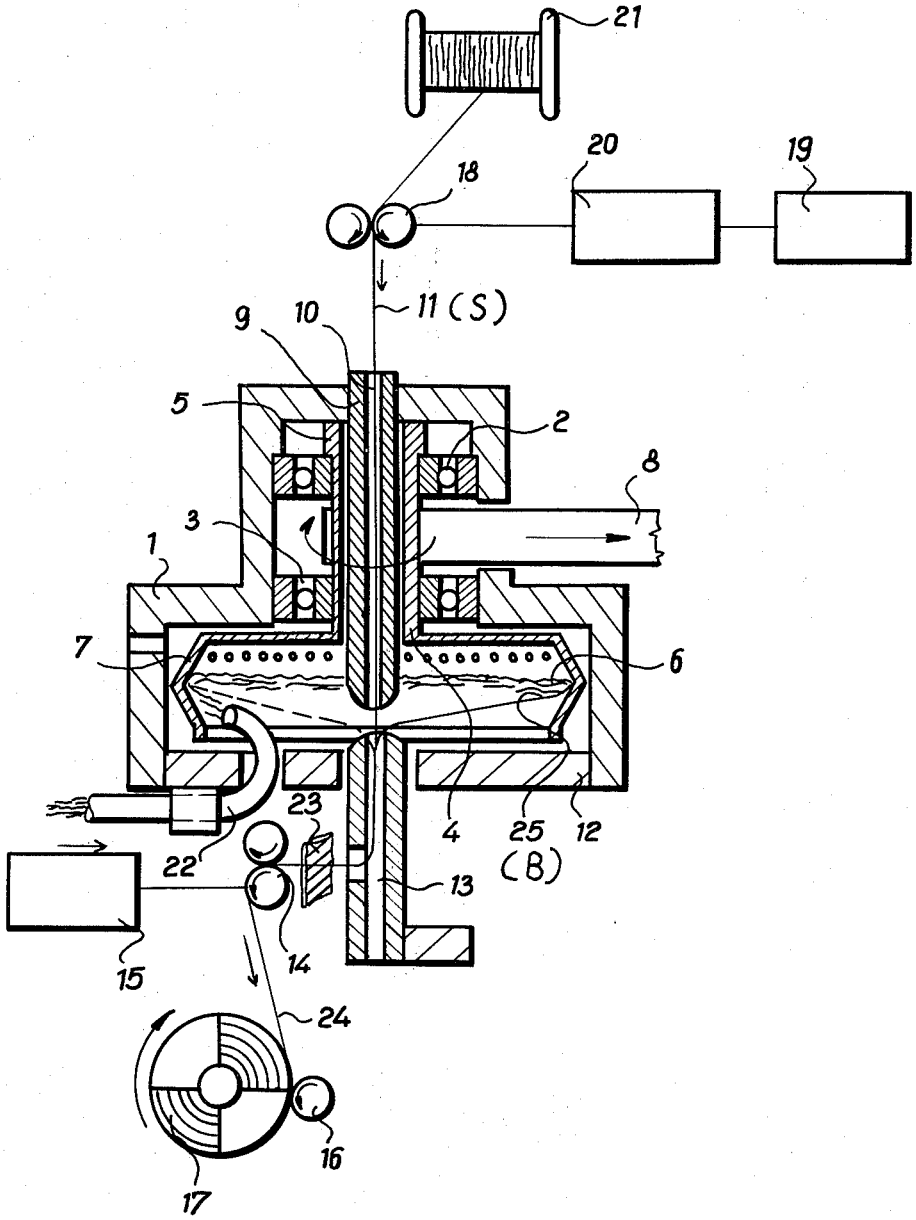
FIG. 6 is a sectional elevation of a spinning apparatus for forming multi-component yarn according to the invention.
Figure 7:
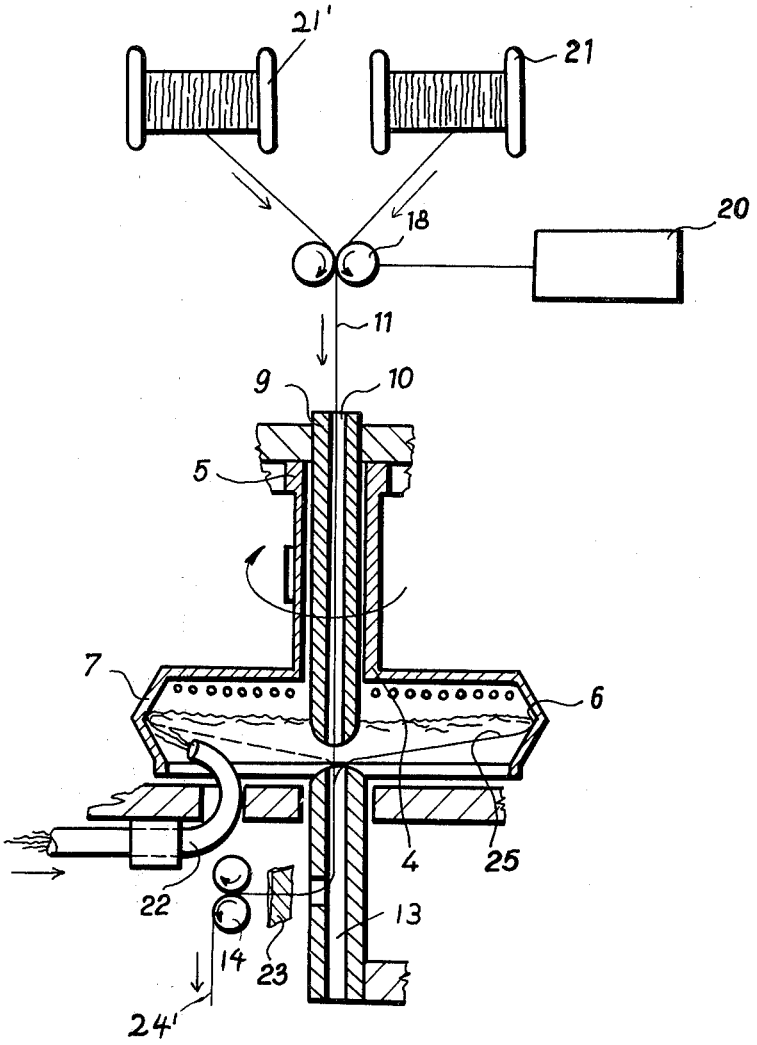
FIG. 7 is a sectional elevation of an exemplary apparatus having means for feeding two longitudinal formations.
Figure 6:
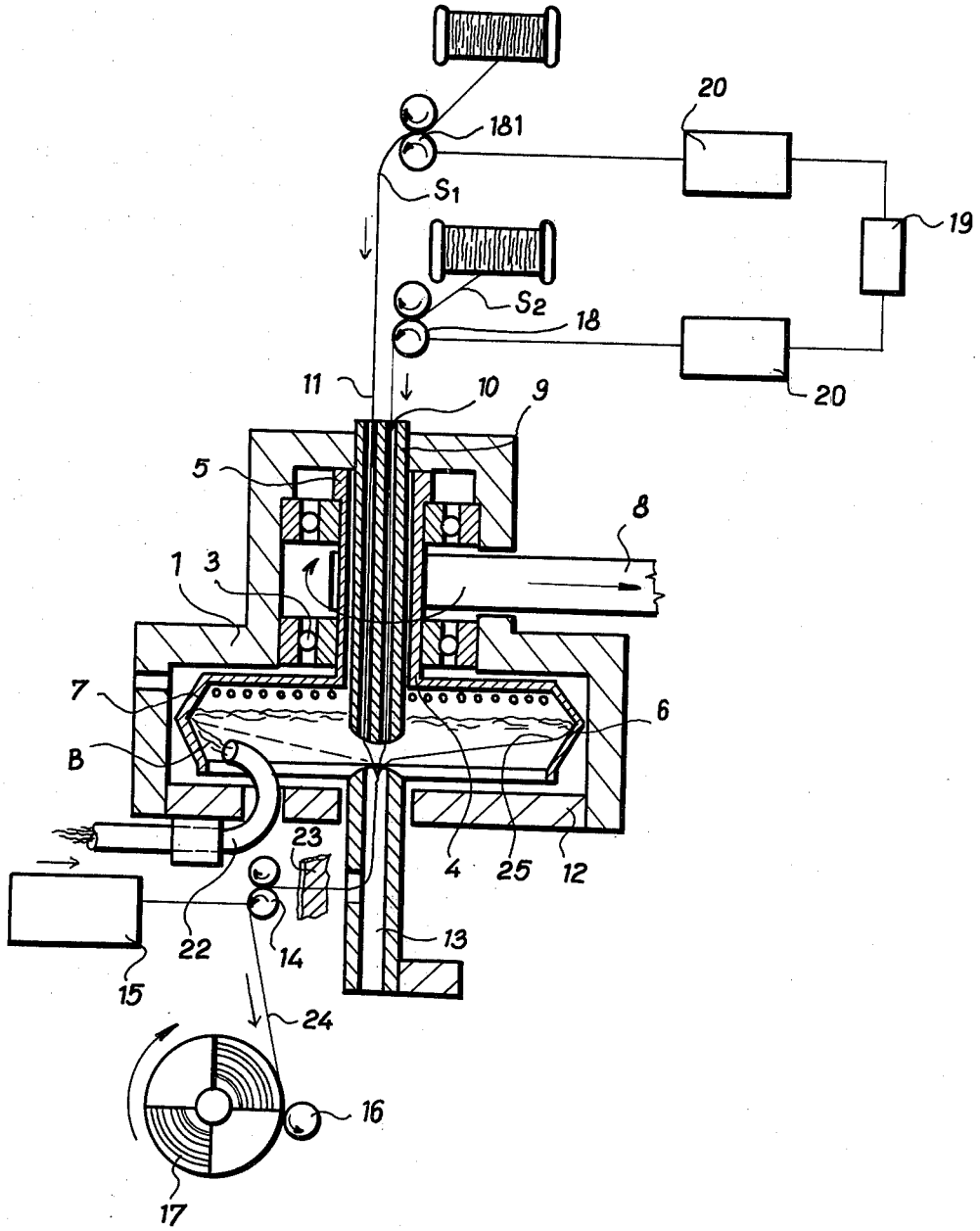

It will be apparent from the above that five embodiments of yarn are shown herein in FIGS. 1–5, incl., respectively, and that three embodiments of apparatus for making the yarn of the inventions are shown in FIGS. 6, 7, and 8, respectively.

DESCRIPTION OF PREFERRED EMBODIMENTS

Figure 1:
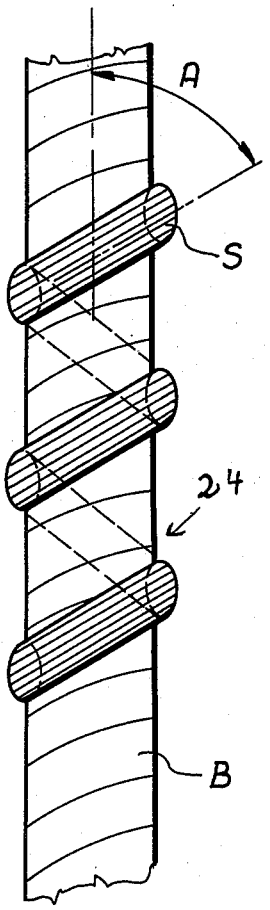
FIG. 1 is a diagrammatic view of a multi-component yarn consisting of two components.

FIG. 1 shows a multi-component yarn 24 composed of an open end yarn B, (spun by the open end method) forming one component arranged along the axis of the resulting yarn; around its surface in the direction of its twists there is wrapped on a second component, the longitudinal formation S. The longitudinal formation S maintains its original character in its wrapped on condition. The open end yarn B forms substantially a straight stretched yarn core having no deviation from its axis resulting from its connection with the second component—the longitudinal formation S; this contrasts with two yarns twisted together. The longitudinal formation S is wound or deposited on the open end yarn B substantially along a regular helix at an angle A with respect to the axis of the yarn; angle A may be varied. The term "longitudinal formation" should be understood to be an auxiliary common term for characterizing the description of multi-component yarns and any type of yarn, whether already spun from staple fibers or formed by a bundle of endless fibers, by silk or other similar formation, for instance, fine metal wire, glass, silk, and the like. It can be also structural yarn, for instance, purl yarn.

An important feature of the multi-component yarn according to this invention is that the longitudinal formation S is wound on the open end yarn B in its starting condition without adding or removing twists. A new type of yarn is thus obtained.

Figure 2:
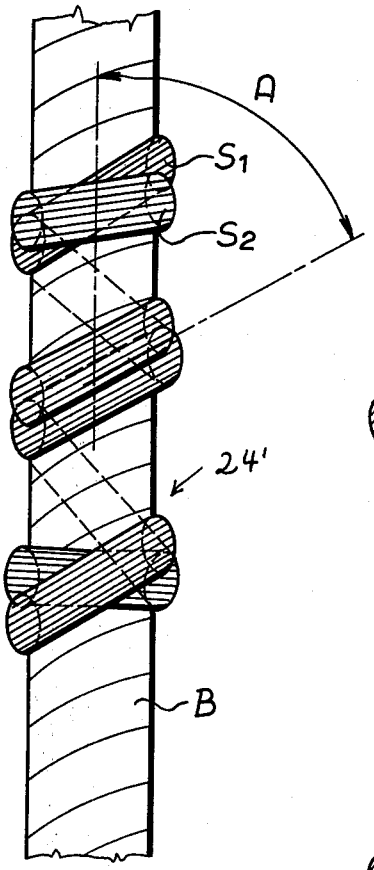
FIG. 2 is a similar view of a multi-component yarn having three components.

A second embodiment of yarn, designated 24', is shown in FIG. 2. In yarn 24' there are at least two longitudinal formations; in FIG. 2 the second component is represented by two longitudinal formations $S_1$ and $S_2$. These formations are, as shown, wound on along the same helix at substantially the same angle A, whereby they can mutually overlap and alternately change their positions on the open end yarn b. The open end yarn B and the longitudinal formations $S_1$, $S_2$, can be made of the same material and of the same or different color. However, they can also be made of different materials of the same or different colors. They can also have the same or different number of fineness.

Figure 3:
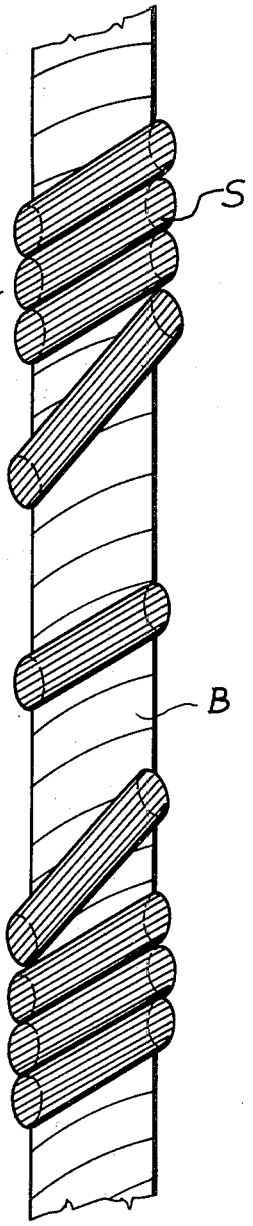
FIG. 3 is a similar view of another type of multi-component yarn wherein the second component has an irregular helix.

A somewhat different type of multi-component yarn is that shown in FIG. 3, wherein the longitudinal formation S is wound along an irregular helix on the open end yarn B; an interesting effect is obtained if a longitudinal formation S of different color is used, as the individual components of the yarn change their positions irregularly.

FIG. 4 shows a multi-component yarn formed on an open end yarn B, on the surface of which there are wrapped the direction of its twist two longitudinal formations $S_1$ and $S_2$ with different but constant pitches of their helices, formations S, and $S_2$ maintaining their original character in the wound on condition. The longitudinal formations are wound onto the open end yarn substantially along a regular helix, each at a different angle A, with respect to the axis of the open end yarn. Such angle is determined by the adjustment of the feeding speed of the longitudinal formations into the take-up channel; such speed must be higher than the entrance speed of the open end yarn into this take-up channel, as will be explained later.

FIG. 5 shows another emamplary embodiment of a similar multi-component yarn, in which the open end yarn is freely or loosely wrapped by one longitudinal formation $S_1$, that is, formation S, at places being spaced from the surface of the open end yarn and forming loops; on formation $S_1$ a second longitudinal formation $S_2$ is wound on. Thus a very effective multi-component yarn is obtained.

The multi-component yarn according to this invention can be manufactured in different modifications and can be changed or completed by different longitudinal formations of different materials and colors with different helical angles of their winding. It is also possible to use more kinds of longitudinal formations, for instance 3, 4 and the like, which have to be supplied each via an independent feeding channel as will be described below. It is also possible to combine the feeding of longitudinal formations so that two longitudinal formations are simultaneously supplied through one channel at equal speeds, and via the remaining two or three channels other longitudinal formations are supplied at different speeds. The speed of supplied longitudinal formations can, of course, be combined in different manners. It is also possible to combine the multi-component yarn with an elastic yarn, which can be fed via one feeding channel at a lower speed than the take-up speed of the open end yarn and thus also of the multi-component yarn, the longitudinal formations being, of course, supplied at a different, higher speed. It is not substantial from the point of view of this invention which relation is obtained between the elastic yarn and the open end yarn, as the mean feature remains: that the remaining longitudinal formations are wound on the open end yarn at a different angle A, even if the open end yarn is combined with the said elastic yarn.

FIG. 6 shows a first embodiment of apparatus according to the invention for the manufacture of the multicomponent yarn 24 of FIG. 1. An open end spinning rotor 4 is by means of its hollow shaft 5 supported freely rotatably in bearings 2, 3 on the housing of the spinning unit. The spinning rotor 4 has a collecting surface 6 at the place of its maximum internal diameter for depositing supplied fibers. It is furthermore provided with ventilation channels 7 for generating underpressure in the internal space which is required for feeding fibers and for the introduction of the end of the yarn at the start of spinning. If the spinning rotor has no ventilation channels the generation of underpressure is secured by connection of the internal space of the spinning rotor 4 to an external source (not shown) for the generation of underpressure. The drive of the spinning rotor 4 is affected by a belt 8 extending from a driving means (not shown). A tube 9 with a feeding channel 10 for feeding the longitudinal formation passes through the hollow shaft 5 along the rotation axis of the rotor 4.

The tube 9 is provided with a feeding channel 10 for feeding a longitudinal formation into the spinning rotor 4 and to a take-up channel 13. The take-up channel 13 is arranged on the axis of rotation of said spinning rotor 4 in the cover 12 closing the open face wall of the rotor 4. The take-up channel 13 has a lateral outlet for the removal of the multicomponent yarn and is at its inlet provided with a so-called "funnel" (not shown), which narrows first in the direction of entrance of individual components of the yarn and later widens. Take-up rollers 14 supported by a machine frame (not shown) and driven by a motor 15 cooperate with the take-up channel 13. A distribution roller 16, resting against a bobbin 17 for winding-on the multicomponent yarn 24, is disposed downstream the take-up rollers 14. A pair of feeding rollers 18 is provided above the tube 9 and are coupled with a driving motor 19 by way of adjustable means 20 such as a PIV speed changer for the adjustment of their rotation speeds independently of the take-up speed of the take-up rollers 14. Said adjustable means 20 are advantageously a regulator or variator, but said term may also cover other means, for instance exchangeable gears in the respective transmission system of the machine. A bobbin 21 carrying coiled longitudinal formations is arranged above the feeding rollers 18; bobbin 21 is rotatably supported in a conventional manner (not shown). A feeding channel 22 for supplying fibers to the collecting surface 6 from a fiber separating mechanism (not shown) terminates furthermore into the spinning rotor 4. A feeler 23 of a yarn break detecting mechanism, operating on the known capacity principle, is provided between the take-up channel 13 and the take-up rollers 14. If a breakage of the multi-component yarn 24 or of one of its components occurs, the feeler 23 causes either a stoppage or withdrawal of the yarn by the take-up rollers 14 or it signals the breakage.

The apparatus of FIG. 6 operates as follows:

The spinning rotor 4 forms from the supplied fibers the first component 25, which is the open end yarn B. The fibers supplied via the feeding channel 22 are deposited on the collecting surface 6 as a band which, due to the rotation of the spinning rotor 4, is rolled up from the collecting surface 6 in a known way to form the open end yarn B. The second component 11) which is the longitudinal formation S, is supplied to the spinning rotor 4 by the feeding rollers 18 via the feeding channel 10. This longitudinal formation is guided in the spinning rotor 4 axially to the take-up channel 13. The size and fineness of the open end yarn B is, as known, determined by numbers and a certain number of fibers, a certain number of twists determined by the number of revolutions of the spinning rotor, and a certain take-up speed, always correspond to a certain number.

The method of forming multicomponent yarn 24 shown in FIG. 1 consists according to this invention in that the longitudinal formation S enters the take-up channel 13 at a higher speed than the open end yarn B and in the course of passage through this take-up channel it is wrapped around the open end yarn B. The take-up speed of the resulting multicomponent yarn 24 corresponds thus to conditions for forming the open end yarn B in the spinning rotor 4. The feeding speed of the longitudinal formation must be at least 5 percent higher than the inlet speed of the open end yarn into said take-up channel.

The apparatus of FIG. 7 is adapted for the formation of the yarn 24' shown in FIG. 2. Parts of the apparatus of FIG. 7 which are similar to those of FIG. 6 are designated by the same reference characters as in FIG. 6. In such apparatus, two longitudinal formations are supplied simultaneously from respective bobbins 21 and 21' and are fed by rolls 18 into the feeding channel 10. A twist-spun yarn 24' of a new quality is obtained; yarn 24' is different from twisted yarns manufactured by classical methods, and it is manufactured in a simple way with a simultaneous formation of one component, the open end yarn.

In FIG. 8 there is shown an apparatus in accordance with the invention which may be employed for forming the yarns of any of FIGS. 2, 4, and 5. Parts in FIG. 8 which are similar to those of FIG. 6 are designated by the same reference characters.

In the apparatus of FIG. 8, the tube 9 is provided with several feeding channels 10 for feeding longitudinal formations into the spinning rotor and to the take-up channel 13. Two channels 10 are shown. The take-up channel 13 is arranged in the rotation axis of said spinning rotor 4 in the cover 12 closing the open face wall of the rotor 4. The take-up channel 13 has either a lateral or direct outlet for removal of the multi-component yarn and is at its inlet provided with a so-called "funnel", which narrows first in direction of entrance of individual components of the yarn and later widens. Take-up rollers 14. One or several couples of feeding rollers 18, 181 are provided above the tube 9 and are coupled with a driving motor 19 by way of adjustable means 20 for adjustment of their rotation speeds independently on the take-up speed of take-up rollers 14. Said adjustable means 20 are advantageously a regulator or variator, but said term may cover also other means, for instance exchangeable gears in the respective transmission system of the machine. A bobbin 21 or several bobbins with longitudinal formations are arranged above the feeding rollers 18, which bobbin is rotatably supported in a not shown manner. A feeding channel 22 for supplying fibers to the collecting surface 6 from a not shown fiber separating mechanism terminates furthermore into the spinning rotor 4. A feeler 23 of a yarn break, operating on the known capacity principle is provided between the take-up channel 13 and the take-up rollers 14. If a breakage of the multi-component yarn or of one of its components occur, the feeler 23 causes either a stoppage of withdrawal of the yarn by the take-up rollers 14 or it signals the breakage.

In the following, typical examples of the manufacture of multi-component yarns are described.

EXAMPLE 1

Open end yarn Nm 40, for instance cotton, number of twists 850, take-up speed for the open end yarn 45 m. $min^{-1}$. A longitudinal formation, viscose silk tex 127 without twists, is supplied, whereby the feeding rollers 18 feed the longitudinal formation to the take-up channel 13 at a speed which is 30 percent higher than the entrance speed of the open end yarn into channel 13. With the thus adjusted speed relations yarn 24 as shown in FIG. 1 is obtained. By adjustment of a higher speed of the longitudinal formation S, for instance 30 percent higher, the deviation angle A of the wound on longitudinal formation with respect to the axis of the open end yarn changes.

EXAMPLE 2

Open end yarn NM 24, number of twists 620, take-up speed 64 m.min$^{-1}$. The longitudinal formation $S_1$ is silk 150 tex of blue color. The longitudinal formation $S_2$ is silk 150 tex of red color. The longitudinal formation $S_1$ and $S_2$ are supplied simultaneously via the feeding channel 10 and are guided to the take-up channel 13 at a speed which is 20 percent higher than the entrance speed of the open end yarn into this channel. The character of the manufactured multicomponent yarn corresponds to the yarn 24' as shown in FIG. 2.

EXAMPLE 3

Open end yarn Nm 40, number of twists 870, take-up speed 46,2 m, min$^{-1}$. The longitudinal formation is polypropylene silk 87 tex, supplied at a speed 55 percent higher than the open end yarn, whereby a uniform helix is achieved in the course of wrapping on the open end yarn. The character of the thus manufactured multicomponent yarn corresponds to FIG. 3.

In the method of the invention of forming multi-component yarn in which the longitudinal formations are wound on with different pitches of the helix the open end yarn formed in the spinning rotor 4 and guided to the take-up channel 13 is wrapped in the course of passage through this channel 13 by longitudinal formations $S_1$ and $S_2$, which are originally supplied separately to the rotating spinning rotor and within this rotor axially to the inlet of the take-up channel at mutually different speeds, which are however higher than the speed at which the open end yarn enters this channel. The take-up speed of the multi-component yarn corresponds to conditions for forming the open end yarn B in the spinning rotor. In order to obtain different multi-component yarns 24, the feeding space of the supplied longitudinal formation $S_1$ and $S_2$ is adjusted. Thus novel twist-spun yarns are obtained, corresponding to those of FIGS. 4 and 5.

EXAMPLE 4

Open end yarn Nm 40, number of twists 870, take-up speed 46 m. min$^{-1}$. The feeding speed of longitudinal formation $S_1$ Nm 40, spun yarn, is 20 percent higher. The longitudinal formations $S_2$ silk 150 tex, feeding speed 30 percent higher than the take-up speed of the open end yarn, i.e., higher than 46 .min$^{-1}$. The character of this multi-component yarn corresponds to that of FIG. 4.

EXAMPLE 5

Open end yarn Nm 24, number of twists 620, take-up speed 65 m. min$^{-1}$. The longitudinal formation $S_1$ spun yarn Nm 40, feeding speed 50 percent higher. Longitudinal formation $S_2$ spun yarn Nm 40, feeding speed 20 percent higher than the take-up speed of the open end yarn and thus also of the multi-component yarn. With these conditions a character of the multi-component yarn is obtained, wherein the longitudinal formation $S_1$ forms loops; such as the yarn of FIG. 5.

Although the invention is illustrated and described with reference to a plurality of preferred embodiments thereof, it is to be expressly understood that it is in no way limited to the disclosure of such preferred embodiments, but is capable of numerous modifications within the scope for the appended claims.

We claim:

1. A method of producing multi-component yarn comprising a core component consisting of open end yarn formed from staple fibers and at least one other component made from a longitudinal formation, the open end yarn being wrapped at its surface in the direction of its twist by at least one longitudinal formation, the original character of said longitudinal formation being maintained in the multi-component yarn, said method comprising the steps of producing within a continuously rotating spinning chamber an open end yarn from fibers supplied to the internal collecting surface of said spinning chamber, taking-up said open end yarn by way of a take-up channel at a certain takeup speed substantially along the rotation axis of the spinning chamber, and winding on this open end yarn at least one longitudinal formation passing through said spinning chamber substantially along its rotation axis and entering the inlet of the take-up channel at a higher speed than the open end yarn, the open end yarn passing directly from the internal collecting surface to the rotation axis of the spinning chamber and not engaging any object until it contacts the longitudinal formation substantially on the rotation axis of the spinning chamber.

2. A method as claimed in claim 1, wherein on the open end yarn at least two longitudinal formations are supplied separately by way of the spinning chamber to the take-up channel at mutually different speeds which are higher than the entrance speed of the open end yarn into the take-up channel.

3. Apparatus for producing a multi-component yarn with a yarn core of an open end yarn formed in a rotating spinning chamber, on which open end yarn at least one longitudinal formation is wound on while maintaining the original character of this formation, said apparatus comprising a rotating spinning chamber with an internal collecting surface, means for feeding fibers to said collecting surface, a take-up channel substantially in the rotation axis of the rotating spinning chamber for taking up the open end yarn formed in the spinning chamber, take-up rollers downstream of the outlet end of said take-up channel, means for imparting to the take-up rollers a speed required for forming the open end yarn, a feeding channel for feeding into the rotating spinning chamber at least one longitudinal formation substantially within the rotation axis of the spinning chamber, means for passing the open end yarn directly from the internal collecting surface to the rotation axis of the spinning chamber without having the open end yarn engage any object until it contacts the longitudinal formation substantially on the rotation axis of the spinning chamber, feeding rollers imparting to each of said longitudinal formations a feeding speed higher than the speed at which the open end yarn formed in the spinning chamber enters the take-up channel, and means for imparting to the feeding rollers the required feeding speed.

4. Apparatus as claimed in claim 3, comprising means for adjusting the feeding speed of said feeding rollers according to the required type of multi-component yarn.

* * * * *